US009612568B2

(12) United States Patent
Kiuchi et al.

(10) Patent No.: US 9,612,568 B2
(45) Date of Patent: Apr. 4, 2017

(54) IMAGE FORMING APPARATUS IN WHICH ADD-ON DEVICE IS MOUNTED

(71) Applicant: FUJI XEROX CO., LTD., Tokyo (JP)

(72) Inventors: Kenji Kiuchi, Kanagawa (JP); Hiroyuki Kono, Kanagawa (JP); Yuichi Sono, Kanagawa (JP); Kenichi Ishikura, Kanagawa (JP); Takehiro Fukuda, Kanagawa (JP); Tsutomu Somemiya, Kanagawa (JP); Youju Lee, Kanagawa (JP); Yongho Choi, Kanagawa (JP); Kyungin Seo, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/001,450

(22) Filed: Jan. 20, 2016

(65) Prior Publication Data

US 2017/0017195 A1 Jan. 19, 2017

(30) Foreign Application Priority Data

Jul. 17, 2015 (JP) ..... 2015-143022

(51) Int. Cl.

| | |
|---|---|
| ***G03G 15/00*** | (2006.01) |
| ***G03G 21/16*** | (2006.01) |
| ***B65H 29/12*** | (2006.01) |

(52) U.S. Cl.

CPC ..... *G03G 21/1619* (2013.01); *B65H 29/125* (2013.01); *B65H 2402/10* (2013.01); *B65H 2402/32* (2013.01); *B65H 2801/27* (2013.01); *G03G 15/6529* (2013.01)

(58) Field of Classification Search

CPC ..... G03G 21/1619
USPC ..... 399/107
See application file for complete search history.

(56) References Cited

U.S. PATENT DOCUMENTS 8,794,616 B2 * 8/2014 Matsuki ..... G03G 15/6544 270/58.07

FOREIGN PATENT DOCUMENTS

| | | | |
|---|---|---|---|
| JP | 2006313252 A | * | 11/2006 |
| JP | 2010072041 A | * | 4/2010 |
| JP | 2010126261 A | * | 6/2010 |
| JP | 2014-106294 A | | 6/2014 |

* cited by examiner

*Primary Examiner* — Quana M Grainger
(74) *Attorney, Agent, or Firm* — Sughrue Mion, PLLC

(57) ABSTRACT

An image forming apparatus includes a housing in which an image forming unit is to be mounted, a support that supports an image reading device in a state where the image reading device is separated from the housing, and a guiding portion in which a guide part, which is formed on a to-be-mounted surface of an add-on device in such a manner as to project, is to be inserted such that the guide part is guided by the guiding portion. Engagement holes with which engagement portions, which are formed on the to-be-mounted surface of the add-on device in such a manner as to project, are to be engaged such that the engagement portions are positioned by the engagement holes are formed in a mounting surface of the housing on which the add-on device is to be mounted.

10 Claims, 15 Drawing Sheets

IMAGE FORMING APPARATUS IN WHICH ADD-ON DEVICE IS MOUNTED

CROSS-REFERENCE TO RELATED APPLICATIONS

This application is based on and claims priority under 35 USC 119 from Japanese Patent Application No. 2015-143022 filed Jul. 17, 2015.

BACKGROUND

Technical Field

The present invention relates to an image forming apparatus.

SUMMARY

According to an aspect of the invention, there is provided an image forming apparatus including a housing in which an image forming unit is to be mounted, a support that supports an image reading device in a state where the image reading device is separated from the housing, and a guiding portion in which a guide part, which is formed on a to-be-mounted surface of an add-on device in such a manner as to project, is to be inserted such that the guide part is guided by the guiding portion. Engagement holes with which engagement portions, which are formed on the to-be-mounted surface of the add-on device in such a manner as to project, are to be engaged such that the engagement portions are positioned by the engagement holes are formed in a mounting surface of the housing on which the add-on device is to be mounted.

BRIEF DESCRIPTION OF THE DRAWINGS

An exemplary embodiment of the present invention will be described in detail based on the following figures, wherein.

DETAILED DESCRIPTION

Figure 1:
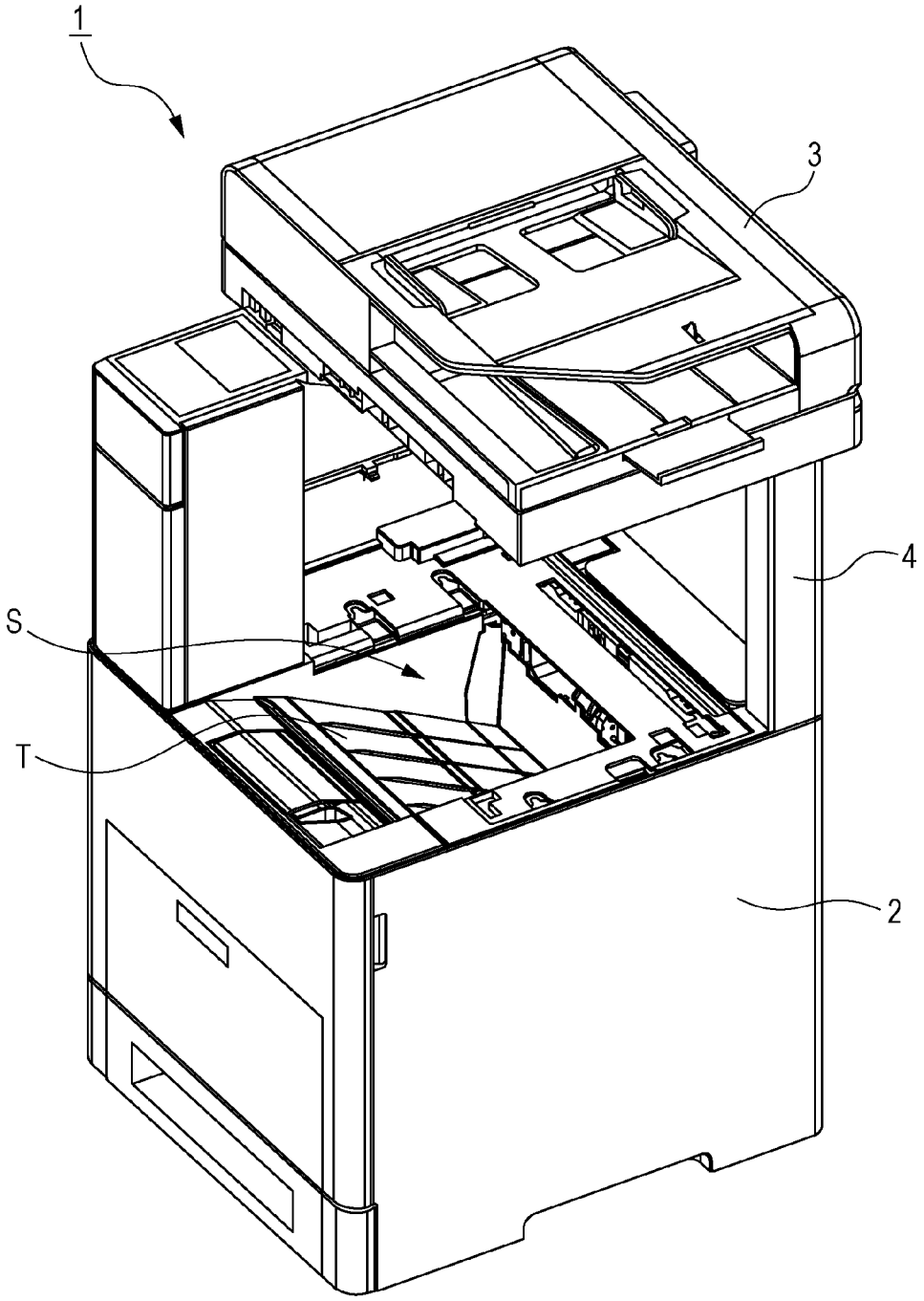
FIG. 1 is a perspective view illustrating the overall appearance of an image forming apparatus.

Although an exemplary embodiment of the present invention will now be described in detail below using a specific example and with reference to the drawings, the present invention is not limited to the following exemplary embodiment and specific example.

In the drawings that will be referred to in the following description, objects are schematically illustrated, and it should be noted that dimensional ratios and so forth of the objects that are illustrated in the drawings are different from those of actual objects. In addition, in the drawings, illustration of components that are not necessary for the following description is suitably omitted for ease of understanding.

For ease of understanding of the following description, in the drawings, a front-rear direction, a left-right direction, and a top-bottom direction are respectively defined as the X-axis direction, the Y-axis direction, and the Z-axis direction.

(1) Overall Configuration and Operation of Image Forming Apparatus

Figure 2:
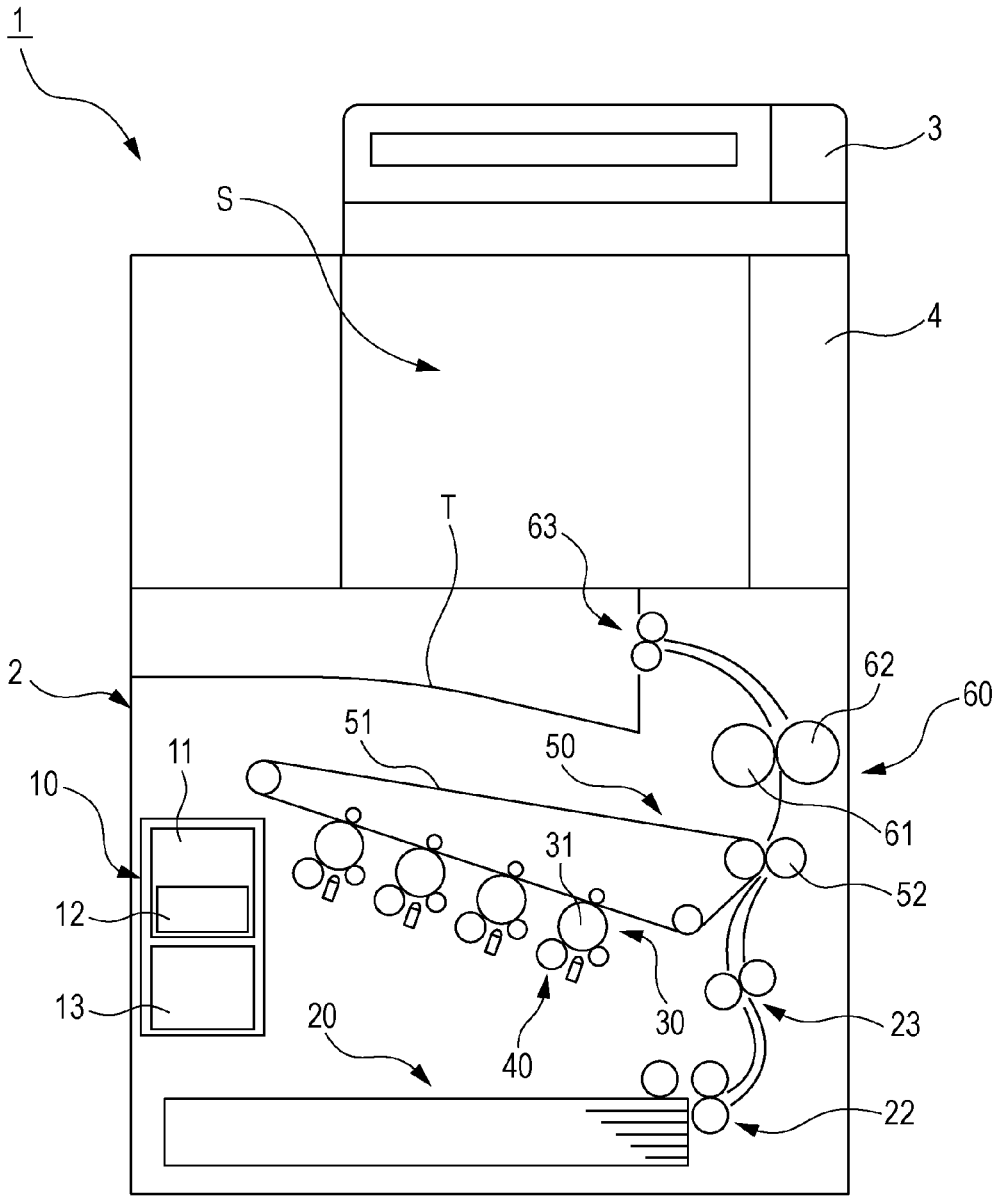
FIG. 2 is a schematic sectional view illustrating the internal structure of the image forming apparatus.

FIG. 1 is a perspective view illustrating the overall appearance of an image forming apparatus 1 according to an exemplary embodiment, and FIG. 2 is a schematic sectional view illustrating the internal structure of the image forming apparatus 1.

The overall configuration and the operation of the image forming apparatus 1 will be described below with reference to the drawings.

(1.1) Overall Configuration

The image forming apparatus 1 includes an image forming apparatus body 2, which employs an electrophotographic system and forms an image, and an image reading device 3, which reads a document and the like and which is supported above the image forming apparatus body 2 by a reading-device-support portion 4. An internal sheet-ejection space S is formed between the image forming apparatus body 2 and the image reading device 3, and sheets P that are ejected by a pair of ejection rollers 63 are to be stacked in the internal sheet-ejection space S.

In the image forming apparatus body 2, a control device 10, a sheet-feeding device 20, photoconductor units 30, developing devices 40, a transfer device 50, and a fixing device 60 are disposed in an internal space defined by a housing 100 (illustrated in FIG. 3), and the housing 100 (illustrated in FIG. 3) is covered with plural individual exterior members 5.

(1.2) Image Forming Apparatus Body

The control device 10 includes an image-forming-apparatus controller 11 that controls the operation of the image forming apparatus 1, a controller unit 12 that prepares image data that corresponds to a request for a printing operation, and a power supply unit 13.

The sheet-feeding device 20 in which the sheets P, which serve as a large number of recording media, are stacked is disposed in a bottom portion of the image forming apparatus body 2, and the sheets P that are positioned by a restricting plate (not illustrated) in a width direction of the sheets P are taken out one by one starting from the uppermost sheet P by a sheet-taking-out unit 22 and then transported to a nip part that is defined by a pair of registration rollers 23.

The photoconductor units 30 are arranged side by side above (higher in the Z-axis direction than) the sheet-feeding device 20 and each include a photoconductor drum 31 serving as an image carrier that is driven so as to rotate. Toner images of yellow (Y), magenta (M), cyan (C), and black (K) are each formed on a corresponding one of the photoconductor drums 31 by a corresponding one of the developing devices 40.

The toner images formed on the photoconductor drums 31 of the photoconductor units 30 are sequentially and electrostatically transferred (in a first transfer process) onto an intermediate transfer belt 51 of the transfer device 50, and a superposed toner image, which is formed of the different color toners superposed with one another, is formed. The superposed toner image on the intermediate transfer belt 51 is transferred onto one of the sheets P, which is sent out by the pair of registration rollers 23 and guided by a transport guide, by a second transfer roller 52.

In the transfer device 50, one of the sheets P to which the toner images have been collectively transferred is transported to the fixing device 60 via the transport guide while the toner images are unfixed to the sheet P, and the toner images are fixed onto the sheet P by a fixing roller 61 and a pressure roller 62, which are paired with each other, as a result of the toner images being heated and pressurized.

Some of the sheets P on which toner images have been formed and fixed are guided by the transport guide and ejected to a sheet-ejection tray T in the internal sheet-ejection space S by the pair of ejection rollers 63 in such a manner as to be stacked on the sheet-ejection tray T.

(2) Configuration of Housing

Figure 3:
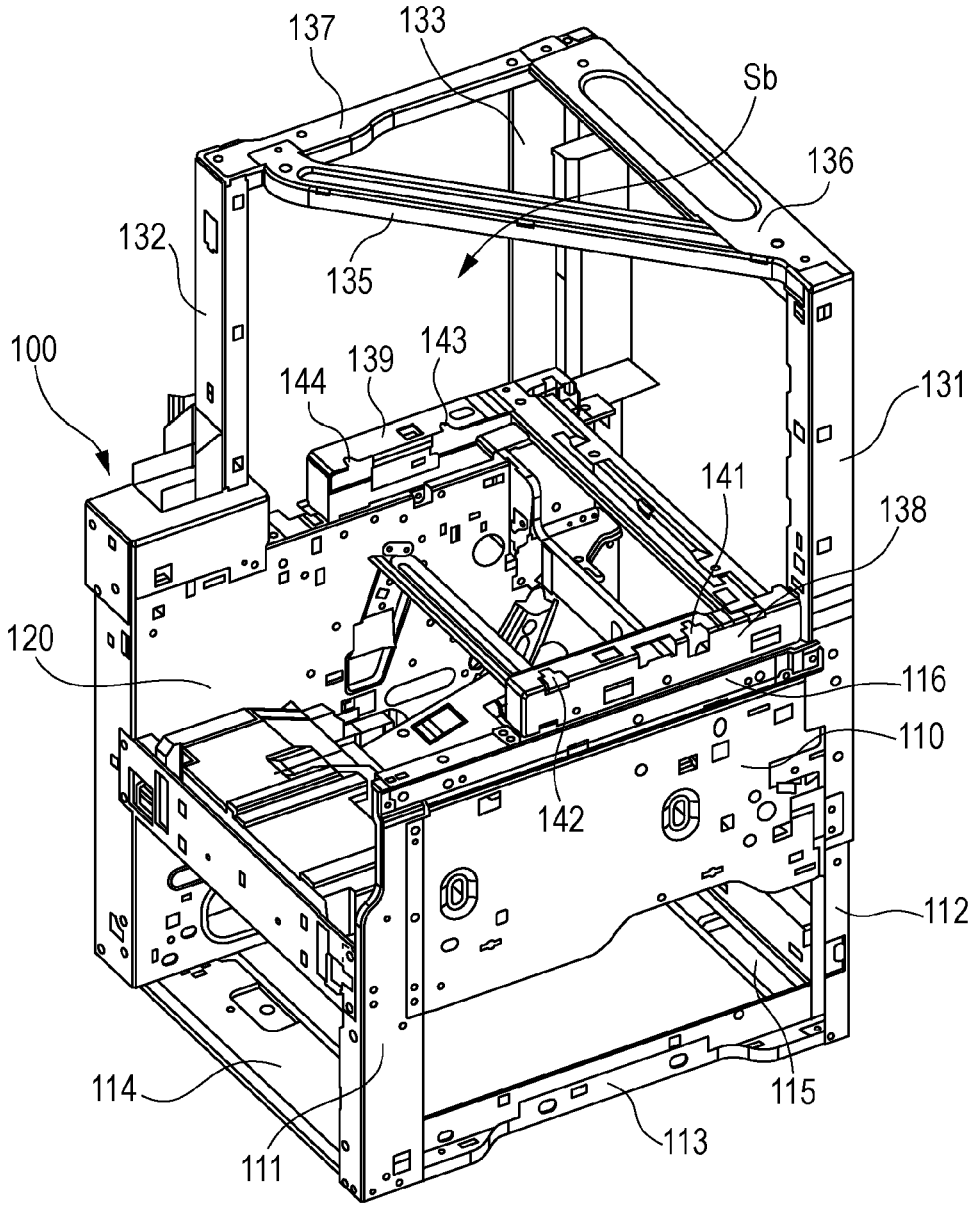
FIG. 3 is a perspective view illustrating the overall configuration of a housing of the image forming apparatus.
Figure 4:
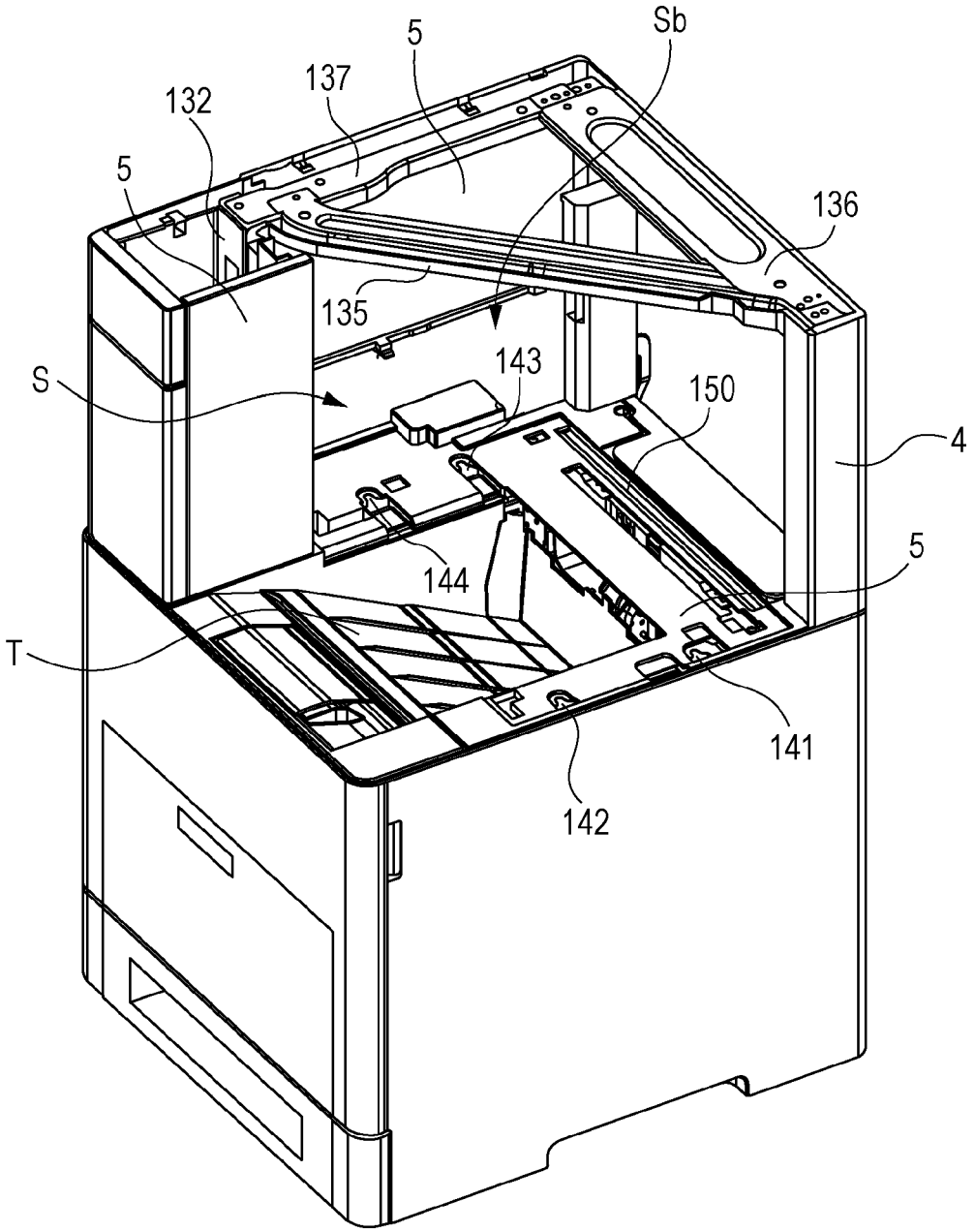
FIG. 4 is a perspective view illustrating a state where exterior members have been attached to the housing.
Figure 5:
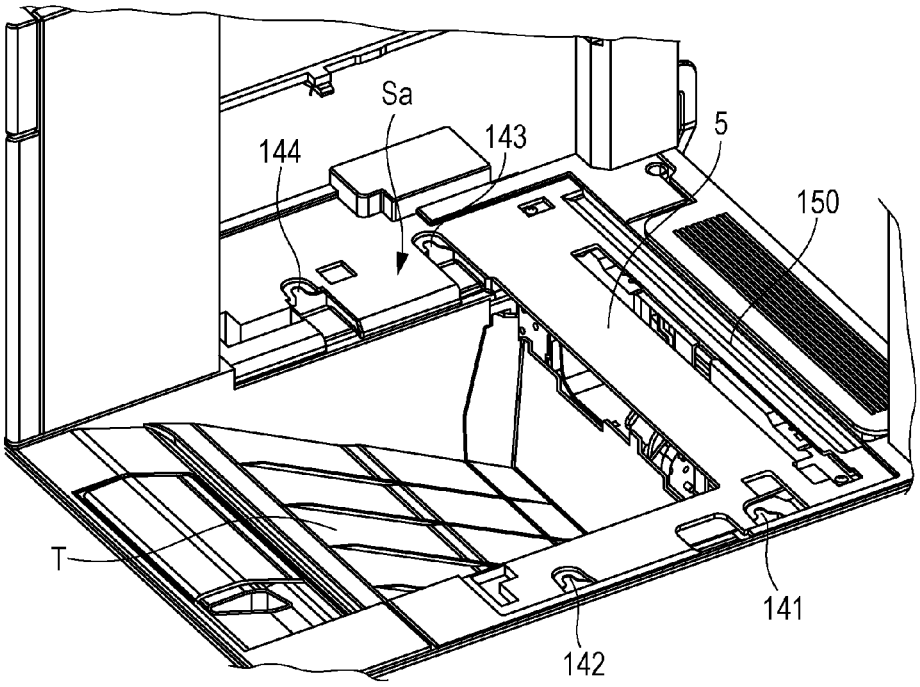
FIG. 5 is a partial perspective view of the image forming apparatus in which a sheet-post-operation device is to be mounted.
Figure 6:
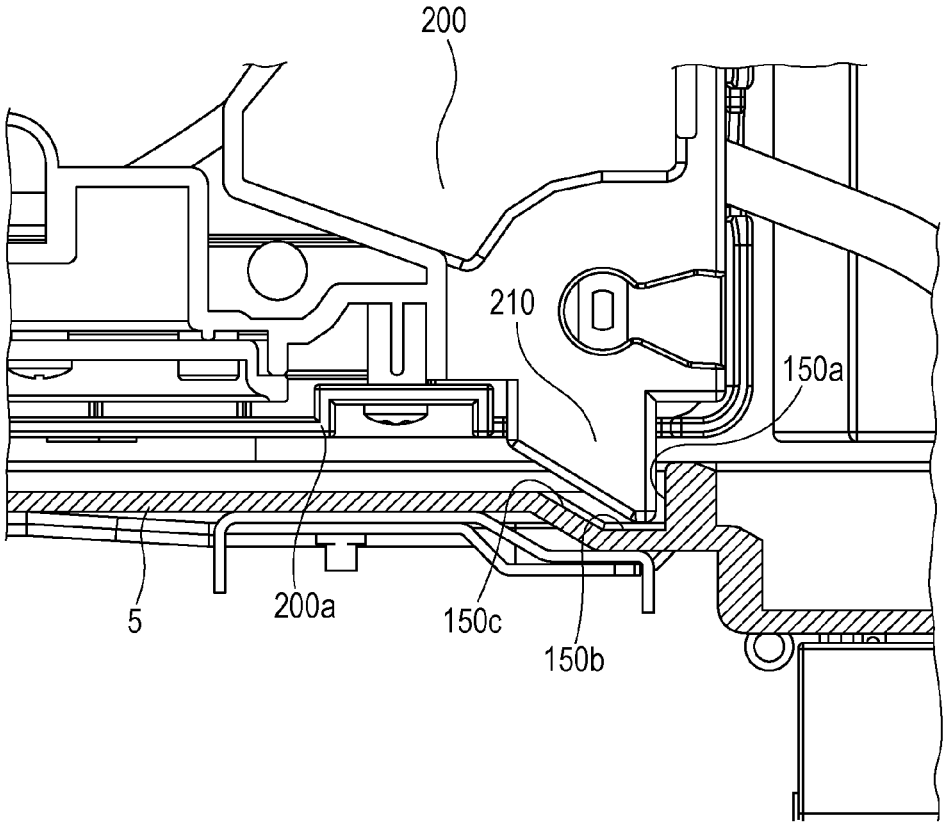
FIG. 6 is a longitudinal sectional view illustrating a guide part of the sheet-post-operation device and a guiding portion of the image forming apparatus.
Figure 7A:
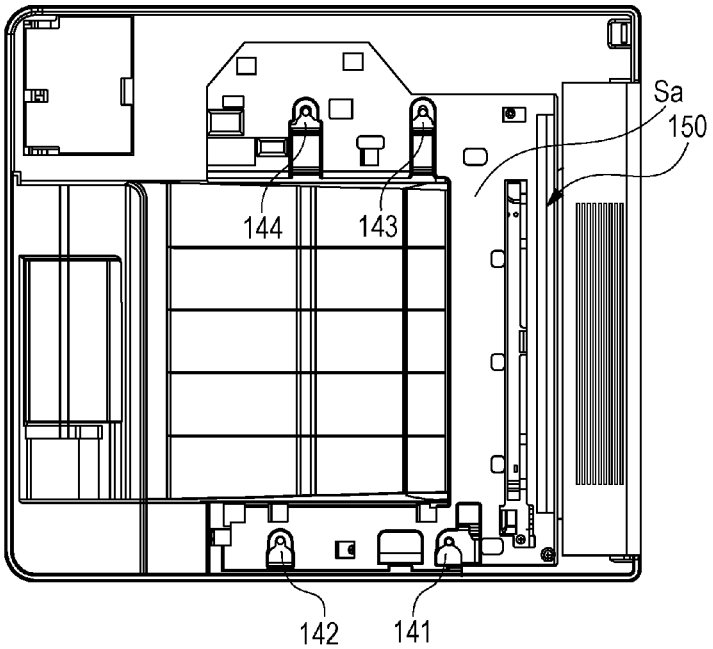
FIG. 7A is a plan view of the image forming apparatus in which the sheet-post-operation device is to be mounted.
Figure 7B:
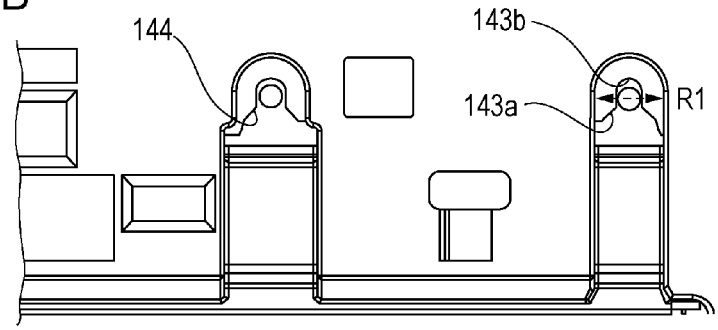
FIGS. 7B and 7C are partial enlarged views illustrating engagement holes formed in a portion on which the sheet-post-operation device is mounted.
Figure 7C:
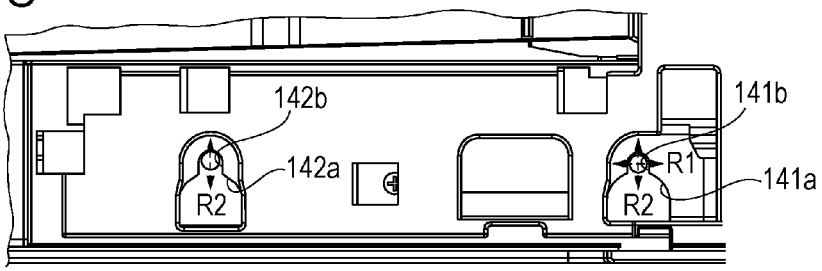
Figure 8A:
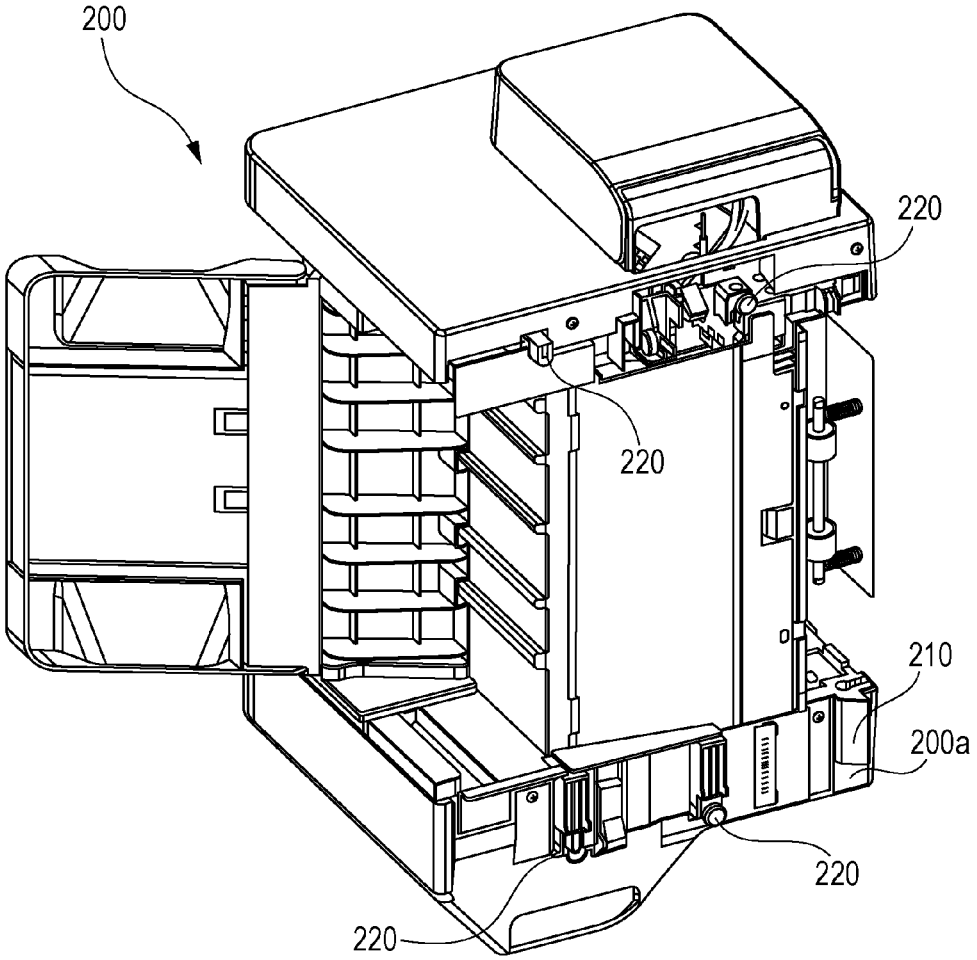
FIGS. 8A and 8B are respectively a perspective view illustrating the sheet-post-operation device focusing on the side on which a to-be-mounted surface of the sheet-post-operation device is present and a partial enlarged view of positioning pins.
Figure 8B:
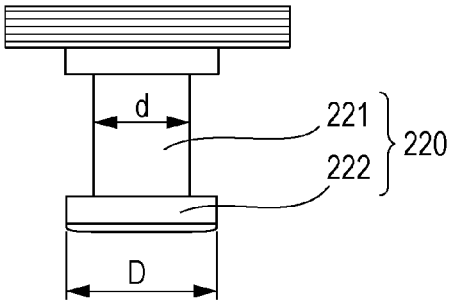

FIG. 3 is a perspective view illustrating the overall configuration of the housing 100 of the image forming apparatus 1. FIG. 4 is a perspective view illustrating a state where the exterior members 5 have been attached to the housing 100. FIG. 5 is a partial perspective view of the image forming apparatus 1 in which a sheet-post-operation device 200 is to be mounted. FIG. 6 is a longitudinal sectional view illustrating a guide part 210 of the sheet-post-operation device 200 and a guiding portion 150 of the image forming apparatus 1. FIG. 7A is a plan view of the image forming apparatus 1 in which the sheet-post-operation device 200 is to be mounted, and FIGS. 7B and 7C are partial enlarged views illustrating engagement holes 141, 142, 143, and 144 formed in a portion on which the sheet-post-operation device 200 is mounted. FIGS. 8A and 8B are respectively a perspective view illustrating the sheet-post-operation device 200 focusing on the side on which a to-be-mounted surface 200*a* of the sheet-post-operation device 200 is present and a partial enlarged view of positioning pins 220.

The configuration of the housing 100 and the configuration of the portion on which the sheet-post-operation device 200, which is an add-on device, is to be mounted will be described below with reference to the drawings.

(2.1) Overall Configuration of Housing

As illustrated in FIG. 3, the housing 100 of the image forming apparatus 1 includes a first side plate 110, a second side plate 120, a first column 111, a second column 112, a first bottom plate 113, a second bottom plate 114, a third bottom plate 115, and a connecting member 116 and has a frame structure. The first side plate 110 and the second side plate 120 face each other. The first column 111 and the second column 112 stand upright on the left and right sides of the first side plate 110. The first bottom plate 113 connects the first column 111 and the second column 112 in a lower portion of the housing 100. The second bottom plate 114 connects the first column 111 and the second side plate 120 in the lower portion of the housing 100. The third bottom plate 115 connects the second column 112 and the second side plate 120 in the lower portion of the housing 100. The connecting member 116 connects the first column 111 and the second column 112 in an upper portion of the housing 100.

Three supports 131, 132, and 133 are vertically arranged above the housing 100 and connected to one another by connecting members 135, 136, and 137.

The three supports 131, 132, and 133 and the connecting members 135, 136, and 137 are included in the reading-device-support portion 4 that supports the image reading device 3 in a state where the image reading device 3 is separated from the housing 100.

A plane defined by the supports 131 and 132 and the connecting member 135 is open to the side on which the first side plate 110 is disposed in such a manner as to form an opening Sb, and the sheet-post-operation device 200, which serves as the add-on device (described later), is mounted in the image forming apparatus 1 by being inserted through the opening Sb.

In a lower portion of the reading-device-support portion 4, a frame body 138 is disposed on the connecting member 116 of the housing 100, and a frame body 139 is disposed on the second side plate 120.

The frame body 138 and the frame body 139 form part of a mounting surface Sa that is a surface on which the sheet-post-operation device 200, which serves as the add-on device (described later), is to be mounted. The engagement holes 141 and 142 are formed in the frame body 138, and the engagement holes 143 and 144 are formed in the frame body 139. Engagement portions of the sheet-post-operation device 200 are inserted into the engagement holes 141, 142, 143, and 144.

(2.2) Internal Sheet-Ejection Space

As illustrated in FIG. 4, the plural exterior members 5 are attached to the housing 100 of the image forming apparatus 1. A side portion and a rear portion of the housing 100 include the reading-device-support portion 4, and a bottom portion of the housing 100 includes the sheet-ejection tray T of the image forming apparatus body 2. A front portion of the housing 100 is open in such a manner as to form the internal sheet-ejection space S.

(2.3) Mounting Portion of Add-On Device

As illustrated in FIG. 5, in the internal sheet-ejection space S, the exterior members 5 that cover a top surface of the image forming apparatus body 2 are mounted in such a manner as to surround the sheet-ejection tray T, so that the mounting surface Sa, which is a surface on which the sheet-post-operation device 200 serving as the add-on device is to be mounted, is formed.

The engagement holes 141, 142, 143, and 144 and the guiding portion 150 are formed in the mounting surface Sa. When the sheet-post-operation device 200 is mounted in the image forming apparatus 1, the engagement portions, which are formed on the to-be-mounted surface 200*a* of the sheet-post-operation device 200 in such a manner as to project, engage with the engagement holes 141, 142, 143, and 144 and are positioned by the engagement holes 141, 142, 143, and 144. The guide part 210, which is formed on the to-be-mounted surface 200*a* of the sheet-post-operation device 200 in such a manner as to project, is inserted into the guiding portion 150 and guided by the guiding portion 150.

(2.3.1) Guiding Portion

As illustrated in FIG. 5, in the mounting surface Sa, the guiding portion 150 is formed in a groove shape in such a manner as to extend from the side on which the first side plate 110 of the housing 100 is disposed toward the side on which the second side plate 120 is disposed.

As illustrated in FIG. 6, the longitudinal cross-sectional shape of the guiding portion 150 is formed of a wall portion 150*a*, a bottom portion 150*b*, and an inclined surface portion 150*c*, and the guide part 210 (see FIG. 8A), which is formed in such a manner as to project toward the side on which the to-be-mounted surface 200*a* of the sheet-post-operation device 200 is present, is to be received in the guiding portion 150 so that the sheet-post-operation device 200 is guided so as to be mounted in the image forming apparatus 1.

(2.3.2) Engagement Holes

As illustrated in FIG. 6 and FIGS. 7A to 7C, the engagement holes 141, 142, 143, and 144 are formed as holes each of which has a keyhole shape or a substantial keyhole shape (hereinafter referred to as keyholes). Each of the keyholes is formed of a guiding hole that has a large diameter and an engagement hole that is connected to the guiding hole.

As illustrated in FIGS. 8A and 8B, positioning pins 220, which serve as the engagement portions, are formed on the to-be-mounted surface 200*a* of the sheet-post-operation device 200 in such a manner as to project. Each of the positioning pins 220 includes a shaft portion 221 and a head portion 222 that is formed at an end of the shaft portion 221 and that has a diameter larger than that of the shaft portion 221. The shaft portion 221 is guided by a corresponding one of the large-diameter guiding holes of the keyholes and positioned by the corresponding engagement hole of the keyhole, and the head portion 222 engages with the engagement hole.

As illustrated in FIG. 7C, the engagement hole 141 that serves as a first keyhole, which is one of the keyholes, is formed of a guiding hole 141*a* and an engagement hole 141*b*. The guiding hole 141*a* has an inner diameter larger than a diameter D of the head portion 222 of a first positioning pin 220, which is one of the positioning pins 220. The engagement hole 141*b* has a width smaller than the diameter D of the head portion 222 and has an elongated hole shape or a substantially elongated hole shape. The engagement hole 141*b* is connected to the guiding hole 141*a*, and the shaft portion 221 of the first positioning pin 220 is fitted into the engagement hole 141*b*. The engagement hole 141 positions the first positioning pin 220 by restricting movement of the first positioning pin 220 in the front-rear and top-bottom directions (see arrows R1 and R2 illustrated in FIG. 7C).

The engagement hole 142 that serves as a second keyhole, which is one of the keyholes, is formed of a guiding hole 142*a* and an engagement hole 142*b*. The guiding hole 142*a* has an inner diameter larger than the diameter D of the head portion 222 of a second positioning pin 220, which is one of the positioning pins 220. The engagement hole 142*b* has a width smaller than the diameter D of the head portion 222 and larger than a diameter d of the shaft portion 221 of the second positioning pin 220. The engagement hole 142*b* is connected to the guiding hole 142*a* and has an elongated hole shape or a substantially elongated hole shape. The length of the engagement hole 142*b* in a guide direction is set to a predetermined length. The engagement hole 142 restricts movement of the second positioning pin 220 in the guide direction (see arrow R2 illustrated in FIG. 7C).

As illustrated in FIG. 7B, the engagement hole 143 that serves as a third keyhole, which is one of the keyholes, is formed of a guiding hole 143*a* and an engagement hole 143*b*. The guiding hole 143*a* has an inner diameter larger than the diameter D of the head portion 222 of a third positioning pin 220, which is one of the positioning pins 220. The engagement hole 143*b* is connected to the guiding hole 143*a* and has a width smaller than the diameter D of the head portion 222. The engagement hole 143*b* has an elongated hole shape or a substantially elongated hole shape, and the width of the engagement hole 143*b* that crosses the guide direction is set to a predetermined width. The engagement hole 143 restricts movement of the third positioning pin 220 in a direction crossing the guide direction (see arrow R1 illustrated in FIG. 7B).

(3) Mounting and Removing of Add-On Device

Figure 9A:
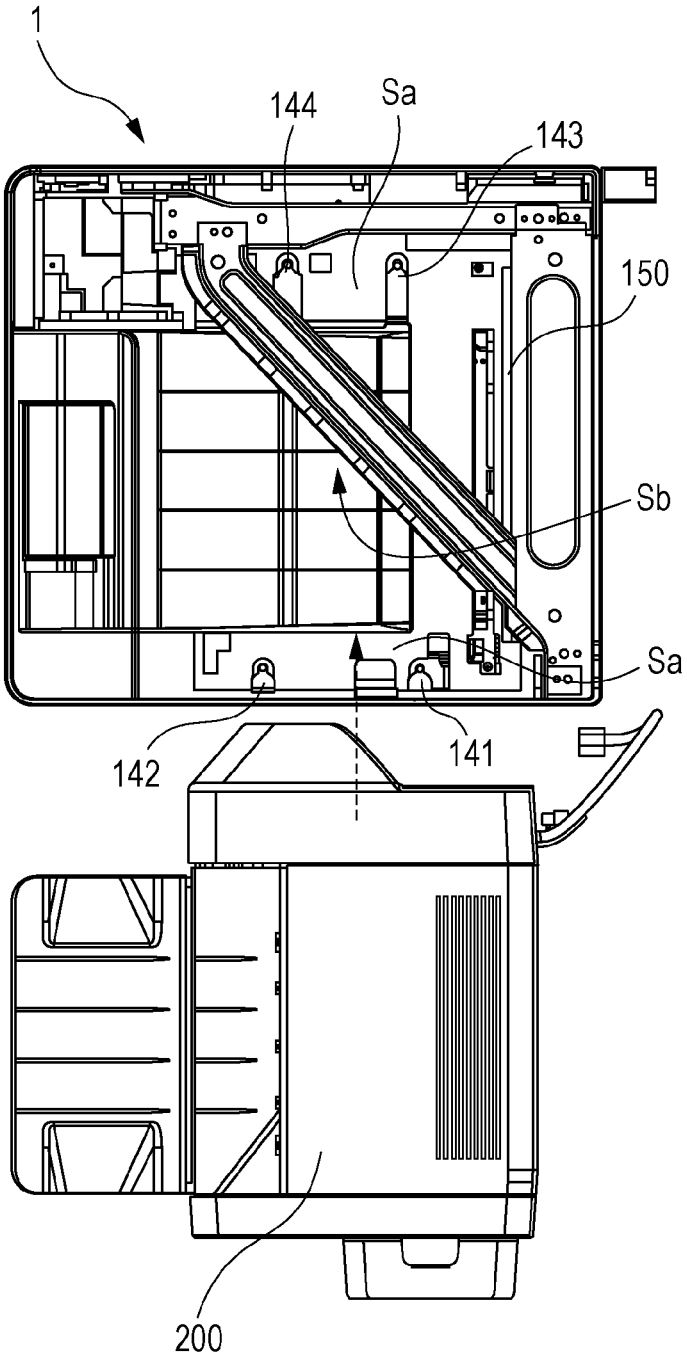
FIGS. 9A, 9B, and 9C are plan views illustrating the flow of an operation of mounting the sheet-post-operation device, which serves as an add-on device, in an internal sheet-ejection space.
Figure 9B:
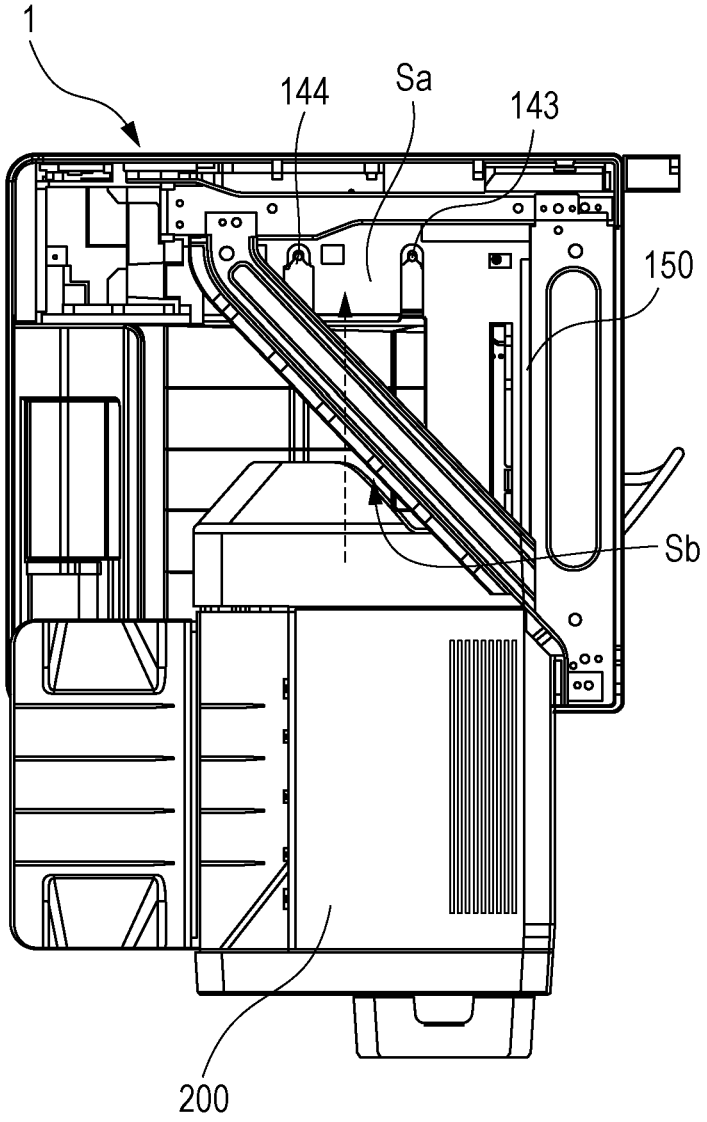
Figure 9C:
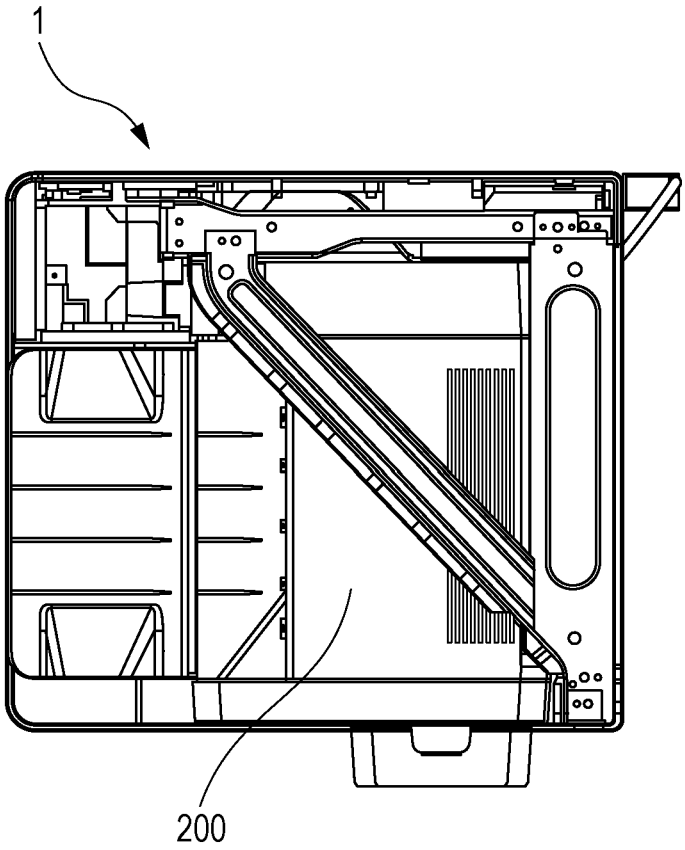
Figure 10A:
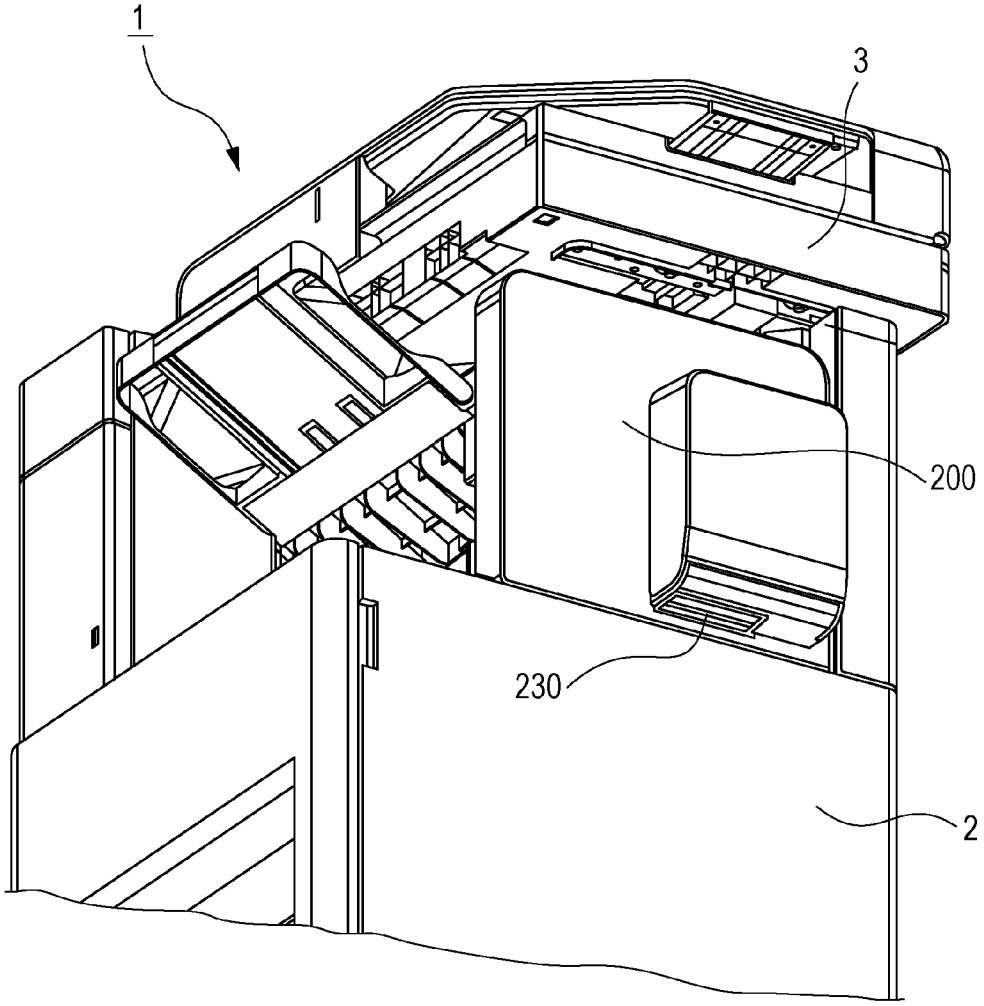
FIGS. 10A and 10B are respectively a perspective view illustrating the image forming apparatus in which the sheet-post-operation device has been mounted focusing on a lower portion of the image forming apparatus and a longitudinal sectional view illustrating a portion of the sheet-post-operation device that has been mounted on the image forming apparatus and that is capable of being removed from the image forming apparatus.
Figure 10B:
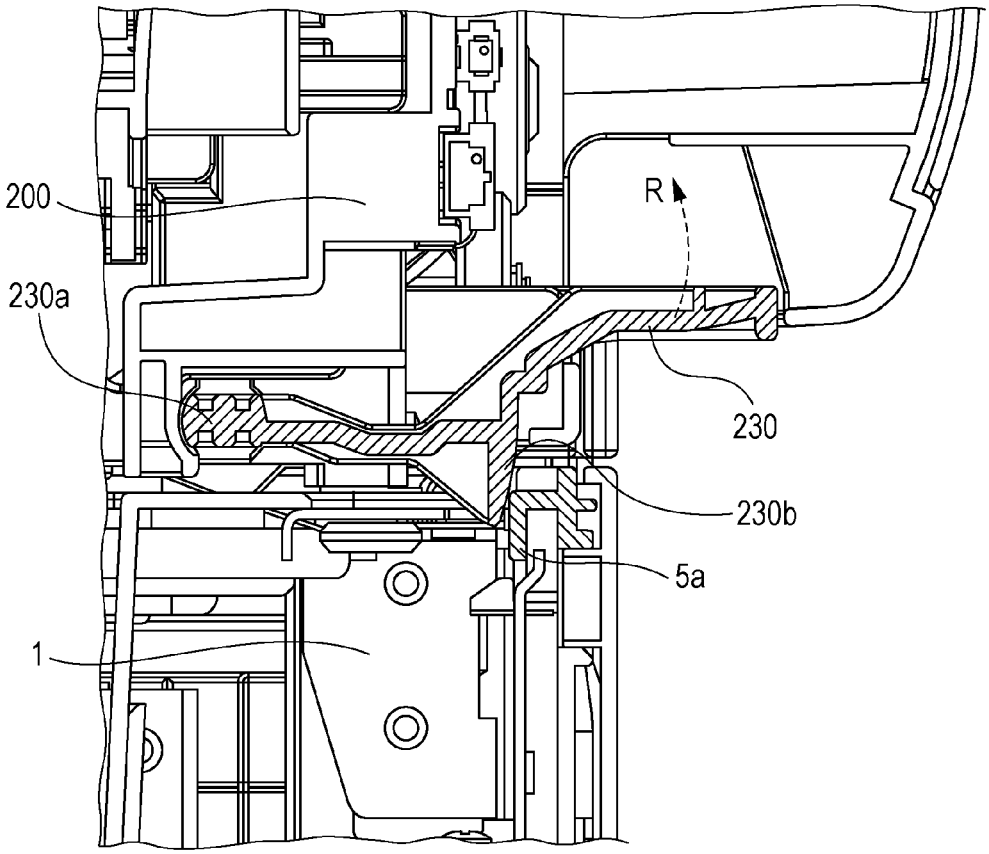
Figure 11A:
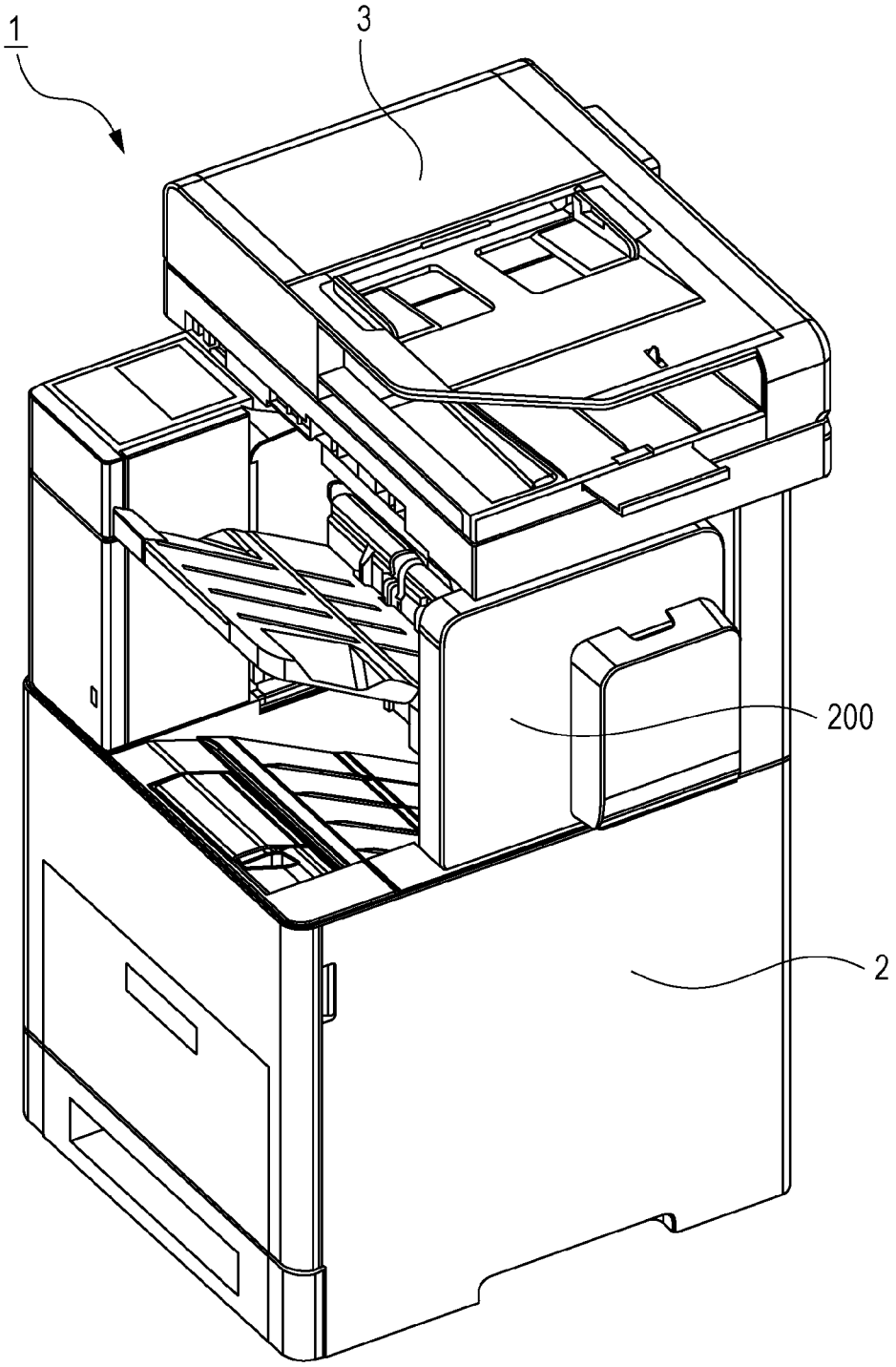
FIGS. 11A and 11B are perspective views of the image forming apparatus on which a mail box has been mounted.
Figure 11B:
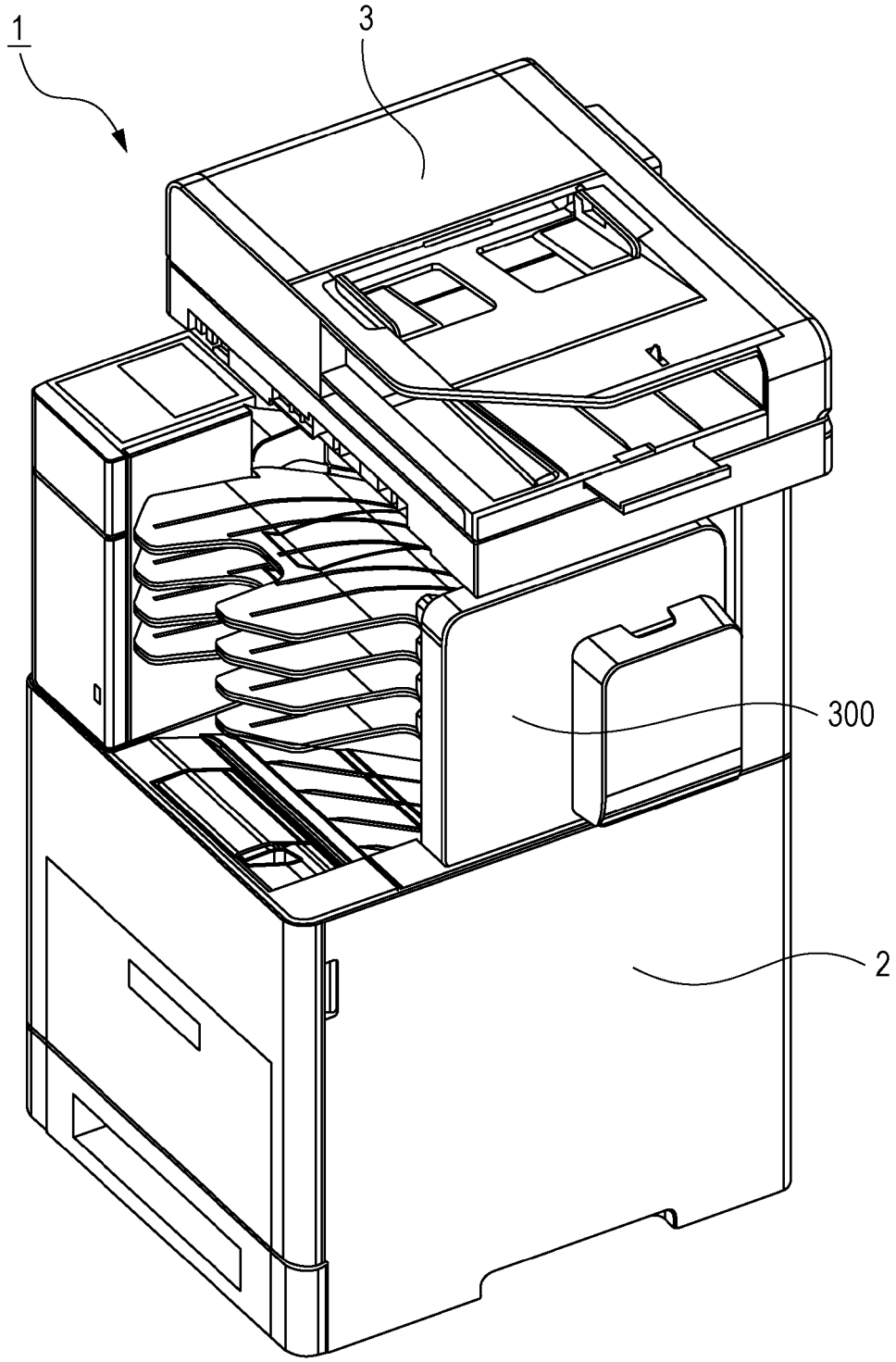

FIGS. 9A, 9B, and 9C are plan views illustrating the flow of an operation of mounting the sheet-post-operation device 200, which serves as the add-on device, in the internal sheet-ejection space S. FIG. 10A is a perspective view illustrating the image forming apparatus 1 in which the sheet-post-operation device 200 has been mounted focusing on a lower portion of the image forming apparatus 1, and FIG. 10B is a longitudinal sectional view illustrating a portion of the sheet-post-operation device 200 that has been mounted on the image forming apparatus 1 and that is capable of being removed from the image forming apparatus 1. FIG. 11A is a perspective view illustrating the entirety of the image forming apparatus 1 on which the sheet-post-operation device 200 has been mounted, and FIG. 11B is a perspective view illustrating the entirety of the image forming apparatus 1 on which a mail box 300 has been mounted.

Operations of mounting and removing the sheet-post-operation device 200 on and from the image forming apparatus 1 will be described below with reference to the drawings.

(3.1) Mounting of Add-On Device

When the sheet-post-operation device 200, which serves as the add-on device, is mounted in the image forming apparatus 1, the sheet-post-operation device 200 is placed on the mounting surface Sa in the internal sheet-ejection space S and inserted into the internal sheet-ejection space S through the opening Sb of the internal sheet-ejection space S while being guided by the guiding portion 150.

Then, as illustrated in FIG. 9B, the guide part 210 of the sheet-post-operation device 200, which is inserted into the internal sheet-ejection space S through the opening Sb, is guided to a groove of the guiding portion 150 formed in the mounting surface Sa, and the positioning pins 220, which are formed on the to-be-mounted surface 200*a* in such a manner as to project, engage with the engagement holes 141, 142, 143, and 144, which are formed in the mounting surface Sa.

The movement of the first positioning pin 220 in the front-rear and top-bottom directions is restricted by the engagement hole 141, and the movement of the second positioning pin 220 in the guide direction and the movement of the third positioning pin 220 in the direction crossing the guide direction are respectively restricted by the engagement hole 142 and the engagement hole 143, so that the positioning pins 220 are positioned on the mounting surface Sa.

(3.2) Mounting and Removing of Add-On Device

As illustrated in FIGS. 10A and 10B, the sheet-post-operation device 200 is provided with an operation lever 230 that is arranged in such a manner as to be rotatable while a support portion 230*a* serves as the center of rotation of the operation lever 230.

An engagement wall 5*a* is formed in one of the exterior members 5, which are included in the mounting surface Sa of the image forming apparatus 1, and in a state where the sheet-post-operation device 200 is mounted in the image forming apparatus 1, an engagement protruding portion 230*b* of the operation lever 230 engages with the engagement wall 5*a*.

When removing the sheet-post-operation device 200 from the mounting surface Sa of the image forming apparatus 1, the sheet-post-operation device 200 is removed from the mounting surface Sa by releasing the engagement of the engagement protruding portion 230*b* and the engagement wall 5*a* of the exterior member 5 by rotating the operation lever 230 in such a manner that the operation lever 230 is raised upward (see arrow R in FIG. 10B).

Although the operations of mounting and removing the sheet-post-operation device 200 have been described above while describing the sheet-post-operation device 200 as an example of an add-on device, the add-on device may be the mail box 300 that includes plural sheet-ejection trays as illustrated in FIG. 11B as long as the add-on device includes, like the sheet-post-operation device 200, a guide part and positioning pins that are formed on a to-be-mounted surface of the add-on device in such a manner as to project.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiments was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a housing in which an image forming unit is to be mounted;

a support that supports an image reading device in a state where the image reading device is separated from the housing; and a guiding portion in which a guide part, which is formed on a to-be-mounted surface of an add-on device in such a manner as to project, is to be inserted such that the guide part is guided by the guiding portion, wherein engagement holes with which engagement portions, which are formed on the to-be-mounted surface of the add-on device in such a manner as to project, are to be engaged such that the engagement portions are positioned by the engagement holes are formed in a mounting surface of the housing on which the add-on device is to be mounted, wherein, in the housing, the guiding portion is arranged in such a manner as to guide the add-on device in a direction crossing a direction in which a recording medium is to be transported, wherein the support includes three columns and a connecting member that connects the three columns, wherein an opening is formed in one of planes that are formed between the three columns, the one of the planes having an area larger than an area of each of the other planes, and wherein the add-on device is to be mounted in the housing by being inserted through the opening.

2. The image forming apparatus according to claim 1, wherein the engagement portions include a plurality of positioning pins each of which includes a shaft portion, which is formed on the to-be-mounted surface of the add-on device in such a manner as to project, and a head portion, which is formed at an end of the shaft portion and which has a diameter larger than a diameter of the shaft portion, and wherein the engagement holes include a plurality of holes each having a substantial keyhole shape, each of the holes being formed of a guiding hole that has an inner diameter larger than the diameter of the head portion and an engagement hole that is connected to the guiding hole and that has a width smaller than the diameter of the head portion and larger than the diameter of the shaft portion and a substantially elongated hole shape.

3. The image forming apparatus according to claim 2, wherein the add-on device is a sheet-post-operation device.

4. The image forming apparatus according to claim 2, wherein the holes each having a substantial keyhole shape include a first hole, which has a substantial keyhole shape and restricts movements of the add-on device inserted into the housing, a second hole, which has a substantial keyhole shape and restricts movement of the add-on device in a guide direction, and a third hole, which has a substantial keyhole shape and restricts movement of the add-on device in a direction crossing the guide direction.

5. The image forming apparatus according to claim 4, wherein the add-on device is a sheet-post-operation device.

6. The image forming apparatus according to claim 1, wherein the add-on device is a sheet-post-operation device.

7. An image forming apparatus comprising:

a housing in which an image forming unit is to be mounted;

a support that supports an image reading device in a state where the image reading device is separated from the housing; and a guiding portion in which a guide part, which is formed on a to-be-mounted surface of an add-on device in such a manner as to project, is to be inserted such that the guide part is guided by the guiding portion, wherein engagement holes with which engagement portions, which are formed on the to-be-mounted surface of the add-on device in such a manner as to project, are to be engaged such that the engagement portions are positioned by the engagement holes are formed in a mounting surface of the housing on which the add-on device is to be mounted, wherein the engagement portions include a plurality of positioning pins each of which includes a shaft portion, which is formed on the to-be-mounted surface of the add-on device in such a manner as to project, and a head portion, which is formed at an end of the shaft portion and which has a diameter larger than a diameter of the shaft portion, and wherein the engagement holes include a plurality of holes each having a substantial keyhole shape, each of the holes being formed of a guiding hole that has an inner diameter larger than the diameter of the head portion and an engagement hole that is connected to the guiding hole and that has a width smaller than the diameter of the head portion and larger than the diameter of the shaft portion and a substantially elongated hole shape.

8. The image forming apparatus according to claim 7, wherein the holes each having a substantial keyhole shape include a first hole, which has a substantial keyhole shape and restricts movements of the add-on device inserted into the housing, a second hole, which has a substantial keyhole shape and restricts movement of the add-on device in a guide direction, and a third hole, which has a substantial keyhole shape and restricts movement of the add-on device in a direction crossing the guide direction.

9. The image forming apparatus according to claim 8, wherein the add-on device is a sheet-post-operation device.

10. The image forming apparatus according to claim 7, wherein the add-on device is a sheet-post-operation device.

* * * * *